US010873150B2

(12) United States Patent
Miyazawa

(10) Patent No.: US 10,873,150 B2
(45) Date of Patent: Dec. 22, 2020

(54) WATER-RESISTANT CONNECTOR

(71) Applicant: Yazaki Corporation, Tokyo (JP)

(72) Inventor: Yuki Miyazawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/438,002

(22) Filed: Jun. 11, 2019

(65) Prior Publication Data

US 2019/0386423 A1 Dec. 19, 2019

(30) Foreign Application Priority Data

Jun. 18, 2018 (JP) ..... 2018-115056

(51) Int. Cl.

| | |
|---|---|
| ***H01R 13/40*** | (2006.01) |
| ***H01R 13/52*** | (2006.01) |
| ***H01R 9/05*** | (2006.01) |
| ***H01R 13/405*** | (2006.01) |
| ***H01R 13/42*** | (2006.01) |
| ***H01R 13/502*** | (2006.01) |

(52) U.S. Cl.

CPC ..... *H01R 13/5202* (2013.01); *H01R 9/0518* (2013.01); *H01R 13/405* (2013.01); *H01R 13/42* (2013.01); *H01R 13/502* (2013.01)

(58) Field of Classification Search

CPC .. H01R 13/5202; H01R 13/502; H01R 13/42; H01R 13/405; H01R 9/0518; H01R 2101/00; H01R 43/20; H01R 13/5804; H01R 13/5219; H01R 13/5205; H01R 13/5045

USPC ..... 439/587

See application file for complete search history.

(56) References Cited

U.S. PATENT DOCUMENTS 7,059,918 B2 * 6/2006 Matsumoto ..... B60L 50/72 439/752

8,840,428 B2 * 9/2014 Omae ..... H01R 13/506 439/582

(Continued)

FOREIGN PATENT DOCUMENTS

CN 201319455 Y 9/2009

DE 10 2015 113 786 A1 2/2017

(Continued)

*Primary Examiner* — Abdullah A Riyami

*Assistant Examiner* — Nelson R. Burgos-Guntin

(74) *Attorney, Agent, or Firm* — Kenealy Vaidya LLP

(57) ABSTRACT

A housing tool that houses an intersecting terminal metal fitting with an electric wire includes a first housing member and a second housing member integrated by fitting cylinder opening parts to each other in an inserting manner. The first housing member includes a first housing chamber that houses a terminal connection part of the terminal metal fitting, a terminal insertion port, and an opening of an opening part of the first housing member through which the terminal metal fitting at an electric wire connection part side is drawn out to the outside. The second housing member includes a second housing chamber that houses the electric wire connection part drawn out from the opening with the end of the electric wire, an electric wire drawing port, and an opening of an opening part of the second housing member through which the terminal metal fitting is drawn out.

14 Claims, 5 Drawing Sheets

(56) References Cited

U.S. PATENT DOCUMENTS

| | | | | |
|---|---|---|---|---|
| 9,022,807 | B2 * | 5/2015 | Uno | H01R 13/6592 439/607.55 |
| 9,343,825 | B2 * | 5/2016 | Kashiwada | H01R 4/34 |
| 10,062,974 | B2 * | 8/2018 | Okamoto | H01R 13/6397 |
| 2012/0100753 | A1 | 4/2012 | Omae et al. | |
| 2012/0122341 | A1 * | 5/2012 | Okamoto | H01R 13/6593 439/607.55 |
| 2012/0315790 | A1 * | 12/2012 | Hein | H01R 13/5812 439/574 |
| 2013/0189879 | A1 * | 7/2013 | Kondo | H01R 9/18 439/607.44 |
| 2014/0148034 | A1 * | 5/2014 | Kashiwada | H01R 13/512 439/345 |
| 2014/0148045 | A1 * | 5/2014 | Kashiwada | H01R 12/00 439/485 |
| 2017/0302019 | A1 | 10/2017 | Horiuchi et al. | |
| 2018/0241147 | A1 | 8/2018 | Loetkemann et al. | |
| 2019/0190211 | A1 * | 6/2019 | Yamanashi | H01R 13/6592 |

FOREIGN PATENT DOCUMENTS

| | | | |
|---|---|---|---|
| EP | 3 062 399 | A1 | 8/2016 |
| JP | 4-25427 | U | 2/1992 |
| JP | 2011-119120 | A | 6/2011 |
| JP | 2013-232367 | A | 11/2013 |
| JP | 2015-225706 | A | 12/2015 |

* cited by examiner 1
20 (CA)
11
21
25
23
13
10
12
22
24a (24)
23a
33a
33
35
31
34
32
43
30 (CA)
42
61
We
62
63
60

1
20 (CA)
11
25
21
23
13
10
12
22
24a (24)
23a
33a
33
35
31
34
32
43
30 (CA)
42
61
We
62
63
60

1
20 (CA)
11
25
21
23
13
10
12
22
24a (24)
23a
33a
33
35
31
34
32
43
30 (CA)
42
61
We
62
63
60

WATER-RESISTANT CONNECTOR

CROSS-REFERENCE TO RELATED APPLICATION(S)

The present application claims priority to and incorporates by reference the entire contents of Japanese Patent Application No. 2018-115056 filed in Japan on Jun. 18, 2018.

BACKGROUND OF THE INVENTION

1. Field of the Invention

The present invention relates to a connector.

2. Description of the Related Art

Conventionally, a connector in which the terminal insertion and extraction direction with respect to a counterpart connector is intersected with the drawing direction of an electric wire has been known. For example, Japanese Patent Application Laid-open No. 2011-119120 and Japanese Patent Application Laid-open No. 2013-232367 disclose what is called an L-shaped connector in which the terminal insertion and extraction direction is orthogonal to the drawing direction.

Because of the intersection form, the physical size of such a connector is desirably reduced in the terminal insertion and extraction direction (what is called reduction in height). For example, the size of a conventional connector is reduced in the terminal insertion and extraction direction, by integrating the housing with the terminal metal fitting and the connection body of the electric wire housed in a mold by insert molding. Moreover, the size of a conventional connector is reduced in the terminal insertion and extraction direction, by inserting the terminal metal fitting and the connection body of the electric wire into the inner space of the housing, and injecting a potting agent in the inner space to be cured. However, to reduce the physical size of the conventional connectors in the terminal insertion and extraction direction, for example, a resin agent, which is the base of the housing, needs time to cure and the potting agent needs time to cure. Thus, there is a room for improvement in terms of production.

SUMMARY OF THE INVENTION

Consequently, an object of the present invention is to provide a connector capable of reducing the physical size in the terminal insertion and extraction direction while suppressing reduction in productivity.

In order to achieve the above mentioned object, a connector according to one aspect of the present invention includes a terminal metal fitting that includes a terminal connection part electrically connected to a counterpart terminal of a counterpart connector, and an electric wire connection part electrically connected to an end of an electric wire; a housing tool that houses the terminal metal fitting with the end of the electric wire; and an electric wire holding tool that holds the electric wire, wherein the terminal metal fitting is an intersecting terminal in which a terminal insertion and extraction direction at the terminal connection part is intersected with an electric wire drawing direction at the electric wire connection part, the housing tool includes a first housing member and a second housing member that are integrated by fitting cylinder opening parts to each other in an inserting manner, the first housing member includes a first housing chamber formed therein that houses the terminal connection part, a terminal insertion port through which the counterpart terminal is inserted into the first housing chamber, and an opening of the opening part of the first housing member through which the terminal metal fitting at the electric wire connection part side is drawn out to outside, and the first housing member is formed in a bent shape in which an orthogonal direction with respect to the terminal insertion port is intersected with an orthogonal direction with respect to the opening of the opening part of the first housing member so as to match an intersection angle of the terminal insertion and extraction direction and the electric wire drawing direction at the terminal metal fitting, and the second housing member includes a second housing chamber formed therein that houses the electric wire connection part of the terminal metal fitting drawn out from the opening of the first housing member with the end of the electric wire, an electric wire drawing port through which the electric wire is drawn out to outside and to which the electric wire holding tool is fitted in an inserting manner, and an opening of the opening part of the second housing member through which the terminal metal fitting at the terminal connection part side is drawn out to outside.

According to another aspect of the present invention, in the connector, it is possible to configure that the first housing member forms the opening part of the first housing member and the first housing chamber of the first housing member into shapes enabling the terminal connection part that has passed through the opening of the opening part of the first housing member to be inserted into the first housing chamber from a tip end, and enabling the terminal connection part to be housed at a prescribed position in the first housing chamber, while relatively rotating the terminal metal fitting inside the first housing chamber after the terminal connection part is inserted.

According to still another aspect of the present invention, in the connector, it is possible to configure that the first housing member has a reduced volume of the first housing chamber within a range capable of securing an insertion trajectory of the tip end of the terminal connection part and a relative rotation trajectory of the terminal metal fitting in the first housing chamber.

According to still another aspect of the present invention, in the connector, it is possible to configure that the terminal metal fitting is formed in an L-shaped terminal in which the terminal insertion and extraction direction is orthogonal to the electric wire drawing direction, and the first housing member is formed in an L-shape in which an orthogonal direction with respect to the terminal insertion port is orthogonal to an orthogonal direction with respect to the opening of the opening part of the first housing member.

According to still another aspect of the present invention, in the connector, it is possible to further include that a water sealing member that is housed in the second housing chamber, and that is brought into close contact with an inner wall surface of the second housing member and an outer peripheral wall of the electric wire on a same axis of the electric wire.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a connector according to the present invention will be described in detail with reference to the accompanying drawings. It is to be understood that this invention is not limited to the embodiment.

Embodiment

An embodiment of the connector according to the present invention will now be described with reference to FIG. 1 to FIG. 5.

Figure 1:
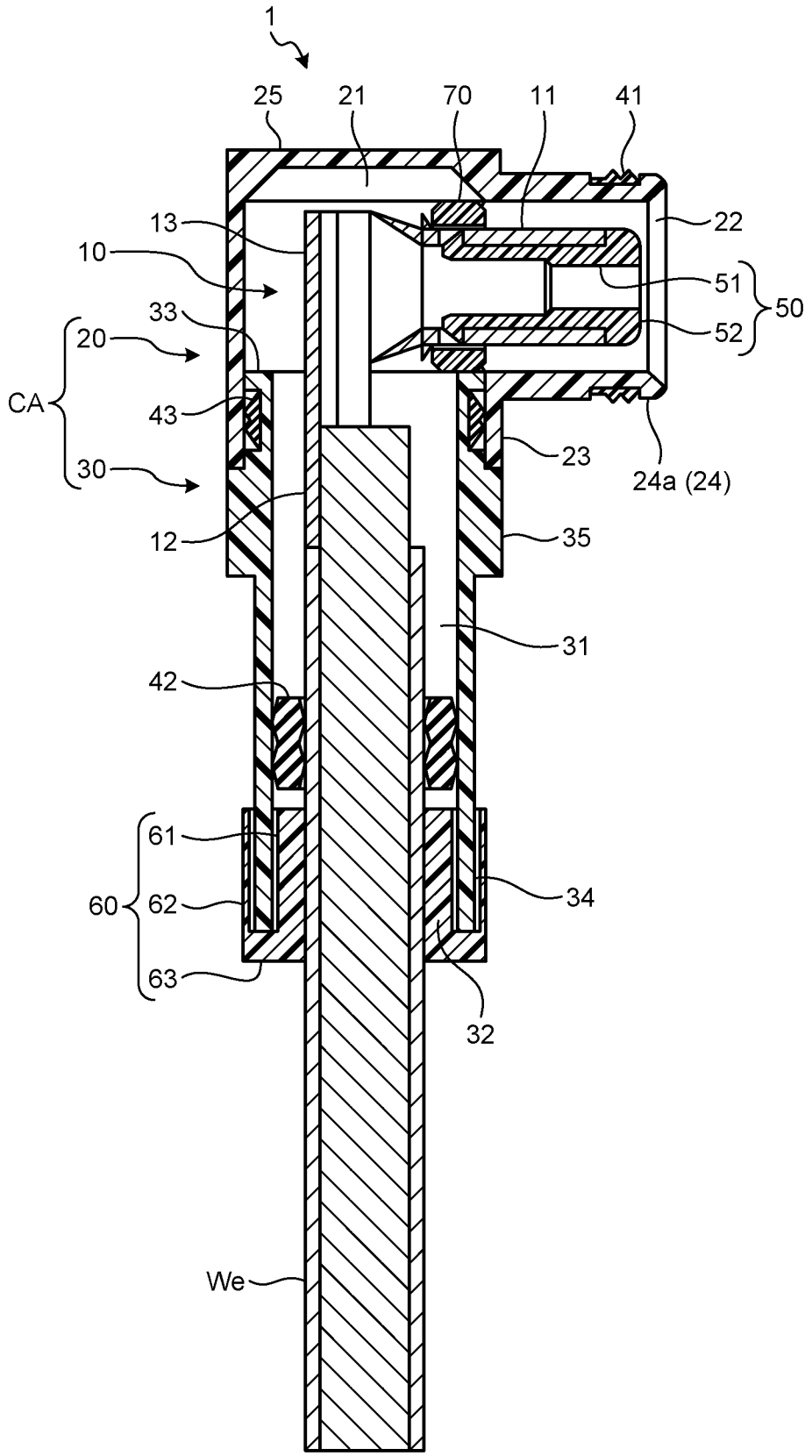
FIG. 1 is a sectional view illustrating a connector of an embodiment after the assembly has completed.
Figure 2:
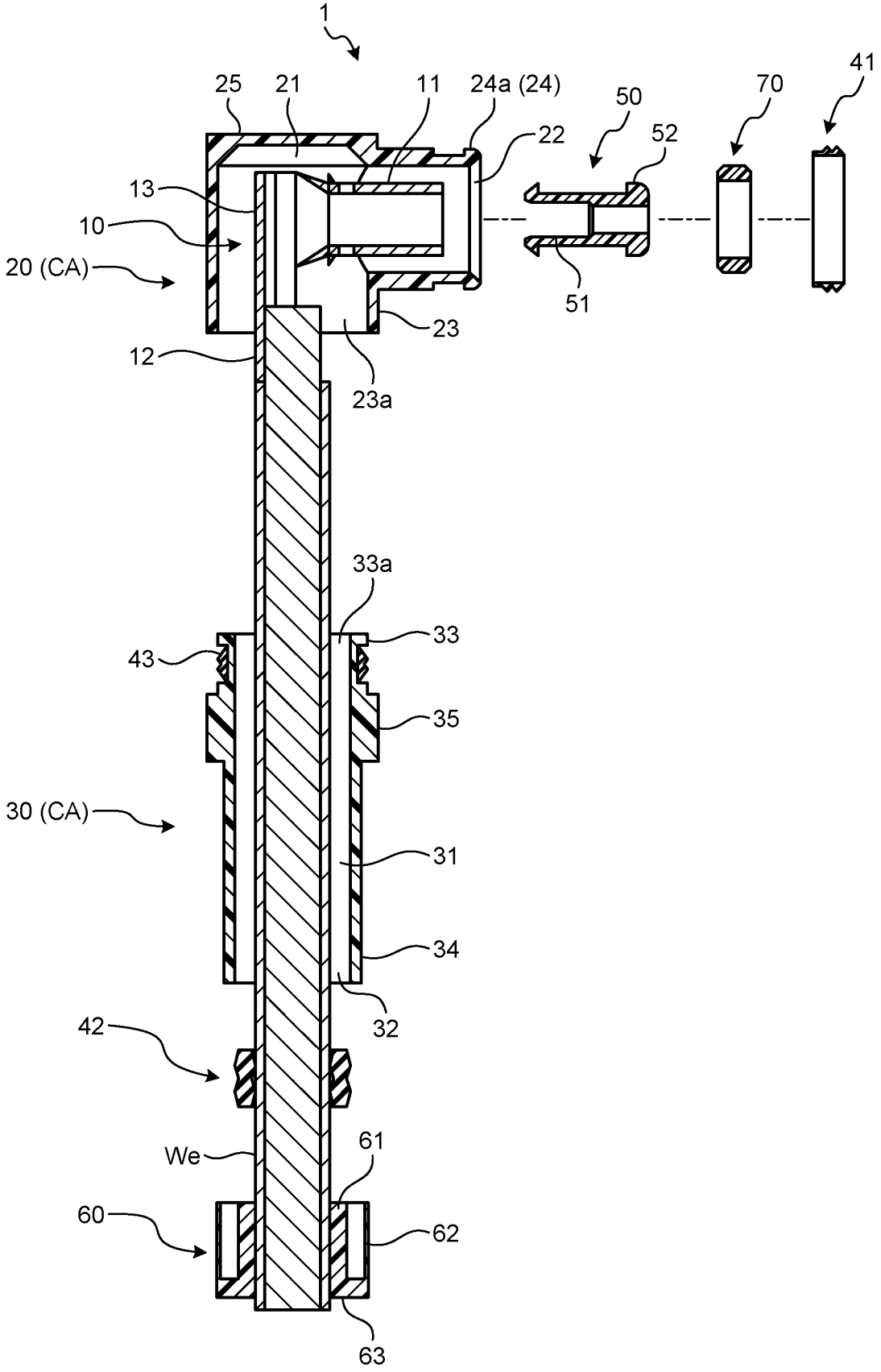
FIG. 2 is a sectional view illustrating the connector of the embodiment before the assembly is completed.

A reference numeral 1 in FIG. 1 and FIG. 2 indicates the connector according to the present embodiment. The connector 1 configures an electric wire with a connector by being electrically connected to an electric wire We. Moreover, the connector 1 configures a connector device with a counterpart connector (not illustrated). The connector device is a device that electrically joins objects to be connected that are electrically connected to two connectors, when the connectors are physically and electrically connected.

Terminals of the connector 1 according to the present embodiment and the counterpart connector are physically and electrically connected to each other, when the connector 1 according to the present embodiment and the counterpart connector are fitted to each other in an inserting manner. On the other hand, when the connector 1 is extracted from the counterpart connector, the physical and electrical connection between the terminals of the connector 1 and the counterpart connector is eliminated. In this example, the inserting and fitting direction of the connector 1 to the counterpart connector is referred to as a "terminal insertion direction", and the extracting direction of the connector 1 from the counterpart connector is referred to as a "terminal extraction direction". When these directions need not be specified, the direction is referred to as a "terminal insertion and extraction direction".

The connector 1 according to the present embodiment may be a female connector including a female terminal or may be a male connector including a male terminal, as long as the connector 1 has a structure to be described in detail below. In the following example, the connector 1 is explained as a female connector.

The connector 1 according to the present embodiment includes a terminal metal fitting 10 and a housing tool CA (FIG. 1 and FIG. 2).

The terminal metal fitting 10 according to the present embodiment is formed in a female shape from a conductive material such as metal (copper, copper alloy, aluminum, aluminum alloy, and the like). In this example, the female-shaped terminal metal fitting 10 is formed by performing a pressing process such as cutting or bending on a conductive metal plate, which is a base material. The terminal metal fitting 10 includes a terminal connection part 11 and an electric wire connection part 12. The terminal connection part 11 is electrically connected to a counterpart terminal (not illustrated) of a counterpart connector. The electric wire connection part 12 is electrically connected to an end of the electric wire We (FIG. 1 and FIG. 2).

The terminal connection part 11 in this example is physically and electrically connected to the counterpart terminal, by being formed in a cylindrical female shape, and by fitting the columnar-shaped terminal connection part of the counterpart terminal into the space portion formed therein in an inserting manner.

The electric wire connection part 12 in this example is physically and electrically connected to the end of the electric wire We. In the end of the electric wire We, the coating of the electric wire We is peeled off, and the core line is exposed. The electric wire connection part 12 is physically and electrically connected to the exposed core line of the end of the electric wire We. The electric wire connection part 12 may also be crimped to the exposed core line by caulking and the like, or may be fixed to the exposed core line by welding and the like. The electric wire connection part 12 in this example is crimped to the exposed core line by caulking and the like.

The terminal metal fitting 10 according to the present embodiment is formed as an intersecting terminal in which the terminal insertion and extraction direction at the terminal connection part 11 is intersected with the electric wire drawing direction at the electric wire connection part 12. In this example, the terminal metal fitting 10 is formed as an L-shaped terminal in which the terminal insertion and extraction direction is orthogonal to the electric wire drawing direction. The terminal metal fitting 10 in the example includes a coupling part 13 that is projected from the electric wire connection part 12 in a direction opposite to the electric wire drawing direction, and that couples the electric wire connection part 12 with the terminal connection part 11 (FIG. 1 and FIG. 2).

Next, the housing tool CA according to the present embodiment will be described.

The housing tool CA according to the present embodiment houses therein the terminal metal fitting 10 with the end of the electric wire We. The housing tool CA also fits the terminal connection part of the counterpart terminal to the terminal connection part 11 of the terminal metal fitting 10 in an inserting manner, and draws out the electric wire We from the inside to the outside. The housing tool CA is formed of an insulation material such as synthetic resin. The housing tool CA includes a first housing member 20 and a second housing member 30 that are integrated by being fitted to each other (FIG. 1 and FIG. 2).

The first housing member 20 includes a first housing chamber 21 formed therein that houses the terminal connection part 11, and a terminal insertion port 22 through which the counterpart terminal is inserted into the first housing chamber 21 (FIG. 1 and FIG. 2). Moreover, the first housing member 20 includes an opening 23*a* through which the terminal metal fitting 10 at the electric wire connection part 12 side is drawn out to the outside (FIG. 2). The first housing member 20 includes a cylinder opening part 23 provided with the opening 23*a* (FIG. 1 and FIG. 2).

In the first housing member 20, the first housing chamber 21 is formed so as to match the shape of the terminal metal fitting 10, and the terminal insertion port 22 and the opening 23*a* are disposed so as to match the shape of the terminal metal fitting 10 (FIG. 1 and FIG. 2). The first housing member 20 in this example is formed in a bent shape so as to house the terminal metal fitting 10 serving as an intersecting terminal. The bent shape is a folded shape in which the orthogonal direction with respect to the terminal insertion port 22 is intersected with the orthogonal direction with respect to the opening 23*a* of the own opening part 23, so as to match the intersection angle between the terminal insertion and extraction direction and the electric wire drawing direction at the terminal metal fitting 10. In this example, the first housing member 20 is formed in an L shape so as to match the terminal metal fitting 10 serving as an L-shaped terminal.

The first housing member 20 in this example includes a first cylinder body 24 and a second cylinder body 25 the cylinder axes of which are orthogonal to each other (FIG. 1 and FIG. 2). In this example, the first cylinder body 24 and the second cylinder body 25 are each formed in a cylindrical shape, and the first cylinder body 24 is projected from the outer wall surface of the second cylinder body 25 in a state in which the space portions formed therein are communicated with each other. Both ends of the first cylinder body 24 in the cylinder axis direction are opened. Alternatively, one end of the second cylinder body 25 in the cylinder axis direction is opened, and the other end of the second cylinder body 25 in the cylinder axis direction is closed.

In the first housing member 20, the first housing chamber 21 is formed in the space portions formed inside the first cylinder body 24 and the second cylinder body 25. Moreover, in the first housing member 20, an opening at a free end (end portion at the projection direction side) of the first cylinder body 24 is used as the terminal insertion port 22, and the opening of the second cylinder body 25 is used as the opening 23*a* of the opening part 23. In the second cylinder body 25, a portion at the opening 23*a* side than the first cylinder body 24 is used as the opening part 23.

In the first housing member 20 in this example, the first housing chamber 21 houses not only the terminal connection part 11, but also a portion of the terminal metal fitting 10 at the electric wire connection part 12 side than the terminal connection part 11. The terminal connection part 11 is housed in the space portion formed inside the first cylinder body 24 on the same cylinder axis. However, an end portion of the terminal connection part 11 at the coupling part 13 side is housed in the space portion formed inside the second cylinder body 25. An end portion of the electric wire connection part 12 at the coupling part 13 side and the coupling part 13 are housed in the space portion formed inside the second cylinder body 25. However, the main portion of the electric wire connection part 12 is drawn out to the outside from the opening 23*a* with the end of the electric wire We.

For example, the first cylinder body 24 is fitted to the inside of the counterpart connector in an inserting manner, from an end portion 24*a* at the terminal insertion port 22 side. Consequently, an annular-shaped water sealing member (what is called packing) 41 is assembled to the outer peripheral wall of the end portion 24*a* on the same axis center (FIG. 1 and FIG. 2). The water sealing member 41 is a member for cutting off water between the outer peripheral surface side of the first cylinder body 24 and the counterpart connector.

The connector 1 according to the present embodiment includes a finger touch prevention tool 50 for preventing a hand or a finger from coming into contact with the terminal connection part 11 from the terminal insertion port 22 with the first housing member 20 (FIG. 1 and FIG. 2). The finger touch prevention tool 50 is formed of an insulation material such as synthetic resin. The finger touch prevention tool 50 includes a cylindrical cylinder body 51 and an annular ring-shaped body 52. The cylinder body 51 is fitted to the space portion formed inside the terminal connection part 11 on the same cylinder axis in an inserting manner. The ring-shaped body 52 covers the tip end surface of the terminal connection part 11 at the terminal insertion port 22 side. For example, in the finger touch prevention tool 50, the size of a gap between the ring-shaped body 52 and the end portion 24*a* of the first cylinder body 24 is formed so as to be smaller than the size of the reference finger. For example, the reference finger refers to the jointed test finger with protection degree IPXXB.

The second housing member 30 includes a second housing chamber 31 formed therein that houses the electric wire connection part 12 of the terminal metal fitting 10 drawn out from the opening 23*a* of the first housing member 20 with the end of the electric wire We. The second housing member 30 also includes an electric wire drawing port 32 through which the electric wire We is drawn out to the outside (FIG. 1 and FIG. 2). Moreover, the second housing member 30 includes an opening 33*a* through which the terminal metal fitting 10 at the terminal connection part 11 side is drawn out to the outside (FIG. 2). The second housing member 30 includes a cylinder opening part 33 provided with the opening 33*a* (FIG. 1 and FIG. 2).

The second housing member 30 may be formed in a bent shape, or may be formed in a linear shape. Although not illustrated, for example, the bent-shaped second housing member 30 includes a first cylinder body that houses the electric wire connection part 12 and both ends of which are opened, and a second cylinder body that only houses the electric wire We and both ends of which are opened. The cylinder axis directions of the first cylinder body and the second cylinder body are intersected with each other. The linearly shaped second housing member 30 is formed from a single cylinder body both ends of which in the cylinder axis direction are opened. In this example, the linearly shaped second housing member 30 formed in a cylindrical shape is used as an example. In the second housing member 30, an opening at one end is used as the electric wire drawing port 32, and an opening at the other end is used as the opening 33*a* of the opening part 33. In the second housing member 30, the other end is used as the opening part 33.

The connector 1 according to the present embodiment includes an electric wire holding tool 60 that holds the electric wire We drawn out from the electric wire drawing port 32 of the second housing member 30 (FIG. 1 and FIG. 2). The electric wire holding tool 60 is assembled to an end portion 34 of the second housing member 30 at the electric wire drawing port 32 side, and is fitted to the electric wire drawing port 32 in an inserting manner. The electric wire holding tool 60 in this example includes an inner cylinder body 61 and an outer cylinder body 62 that are disposed on the same cylinder axis at an interval from each other in the radial direction, that are formed in a cylindrical shape, and both ends of which are opened. End portions of the inner cylinder body 61 and the outer cylinder body 62 in the cylinder axis direction are coupled by an annular ring-shaped body 63. The outer peripheral surface of the inner cylinder body 61 is fitted to the inner peripheral surface of the end portion 34 of the second housing member 30 on the same cylinder axis in an inserting manner. Moreover, the inner peripheral surface side of the inner cylinder body 61 supports the outer peripheral surface of the electric wire We. The inner peripheral surface of the outer cylinder body 62 is fitted to the outer peripheral surface of the end portion 34 of the second housing member 30 on the same cylinder axis in an inserting manner.

Furthermore, the connector 1 according to the present embodiment includes a water sealing member 42 housed in the second housing chamber 31 of the second housing member 30 (FIG. 1 and FIG. 2). The water sealing member 42 is a member for cutting off water between the inner peripheral wall of the second housing member 30 and the outer peripheral wall of the electric wire We. The water sealing member 42 is formed in an annular shape, and brought into close contact with the inner wall surface of the second housing member 30 and the outer wall surface of the electric wire We on the same axis of the electric wire We.

The first housing member 20 and the second housing member 30 described above form the housing tool CA, by integrating the opening parts 23 and 33 by fitting the opening parts 23 and 33 to each other in an inserting manner.

In this example, the opening part 33 of the second housing member 30 is fitted to the inside of the opening part 23 of the first housing member 20 in an inserting manner. Thus, an annular-shaped water sealing member (what is called packing) 43 is assembled to the outer peripheral wall of the opening part 33 of the second housing member 30 on the same axis center (FIG. 1 and FIG. 2). The water sealing member 43 is a member for cutting off water between the inner peripheral wall of the opening part 23 of the first housing member 20 and the outer peripheral wall of the opening part 33 of the second housing member 30. The water sealing member 43 is brought into close contact with the inner wall surface of the opening part 23 and the outer wall surface of the opening part 33.

Moreover, the first housing member 20 in this example is provided with a terminal holding tool 70 for regulating the position of the terminal metal fitting 10 in the first housing chamber 21 (FIG. 1 and FIG. 2). The terminal holding tool 70 is formed in an annular shape, and for example, the outer peripheral side of the terminal holding tool 70 is held by the inner wall surface of the first housing member 20. The terminal connection part 11 is inserted into the terminal holding tool 70 on the same cylinder axis, and the inner peripheral surface side of the terminal holding tool 70 holds the terminal connection part 11.

Moreover, the second housing member 30 in this example includes a cylindrical or annular projection part 35 that is projected to the outside in the radial direction on the same cylinder axis, at the electric wire drawing port 32 side than the water sealing member 43 on the outer peripheral wall (FIG. 1 and FIG. 2). The projection part 35 is a portion for engaging the annular-shaped end surface of the opening part 23, when the opening part 33 is fitted to the inside of the opening part 23 of the first housing member 20 in an inserting manner. The positions of the first housing member 20 and the second housing member 30 in a state in which the first housing member 20 and the second housing member 30 are fitted to each other in an inserting manner, are regulated by the projection part 35.

In the connector 1 according to the present embodiment described above, while the terminal metal fitting 10 and the electric wire We are physically and electrically connected, the second housing member 30 is assembled to the first housing member 20, by housing the terminal metal fitting 10 in the first housing chamber 21 of the first housing member 20 from the terminal connection part 11 side. The electric wire We is inserted into the second housing chamber 31 of the second housing member 30 in advance. Then, the opening part 23 and the first housing chamber 21 of the first housing member 20 according to the present embodiment are formed into shapes enabling the terminal connection part 11 that has passed through the opening 23*a* of the opening part 23 of the first housing member 20 to be inserted into the first housing chamber 21 from the tip end, and enabling the terminal connection part 11 to be housed at a prescribed position in the first housing chamber 21, while relatively rotating the terminal metal fitting 10 inside the first housing chamber 21 after the terminal connection part 11 is inserted. The prescribed position is the housing completion position of the terminal connection part 11 in the first housing chamber 21.

In the connector 1 according to the present embodiment, the terminal connection part 11 is housed in the first housing chamber 21, while relatively rotating the terminal metal fitting 10 after the terminal connection part 11 is inserted from the tip end in this manner. Consequently, it is possible to reduce the physical size of the first housing member 20, by reducing the volume of the first housing chamber 21 within a range that does not disturb the movement of the terminal metal fitting 10. In other words, in the connector 1 according to the present embodiment, it is possible to reduce the physical size of the first housing member 20, by reducing the volume of the first housing chamber 21 within a range that can secure the insertion trajectory of the tip end of the terminal connection part 11 and the relative rotation trajectory of the terminal metal fitting 10 in the first housing chamber 21. In the connector 1, it is possible to reduce the physical size of the first housing member 20 in the cylinder axis direction (in other words, the terminal insertion and extraction direction) of the first cylinder body 24. For example, the opening part 23 and the first housing chamber 21 of the first housing member 20 may be formed into shapes so as to allow the terminal metal fitting 10 to come into contact with the wall surface (inner wall surface of the first housing member 20) of the first housing chamber 21, within a range that does not disturb the insertion operation of the terminal connection part 11 from the tip end and the relative rotation operation of the terminal metal fitting 10. Consequently, the first housing member 20 can reduce the volume of the first housing chamber 21 within a range that does not disturb the movement of the terminal metal fitting 10 such as above.

Moreover, in the first housing member 20, it is preferable to set the length of the opening part 23 in the cylinder axis direction to the shortest length necessary to maintain the fitting state with the opening part 33. Consequently, in the first housing member 20, the terminal metal fitting 10 is prevented from catching the wall surface formed inside the opening part 23, while the terminal metal fitting 10 is relatively rotated. Thus, the physical size of the connector 1 according to the present embodiment can be reduced in the orthogonal direction with respect to the cylinder axis direction of the opening part 23.

Figure 3C:
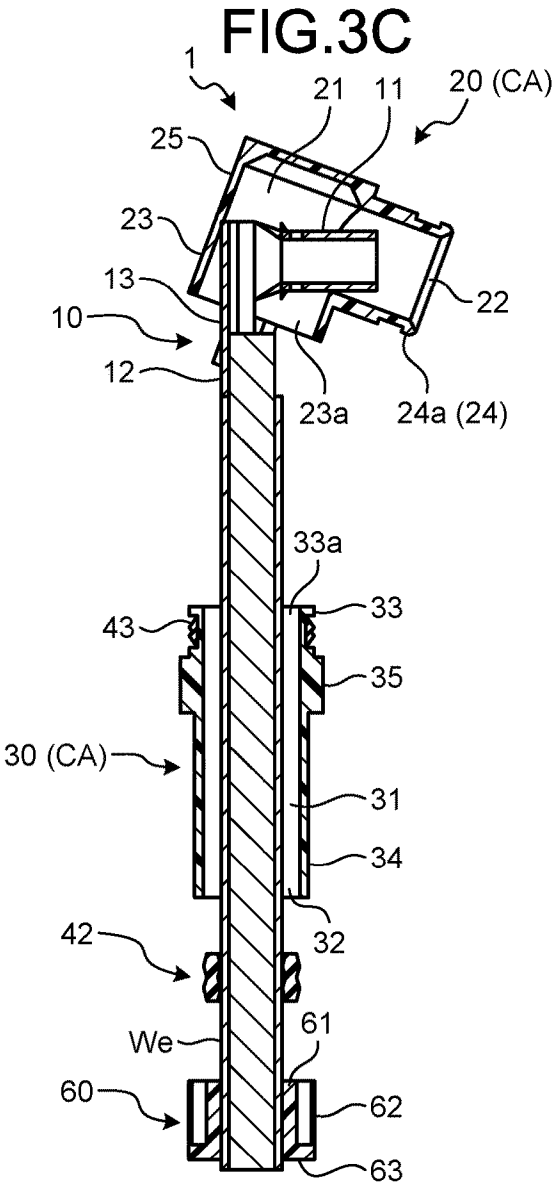
FIGS. 3A to 3C are a diagrams for explaining an assembly process of the connector of the embodiment.
Figure 3B:
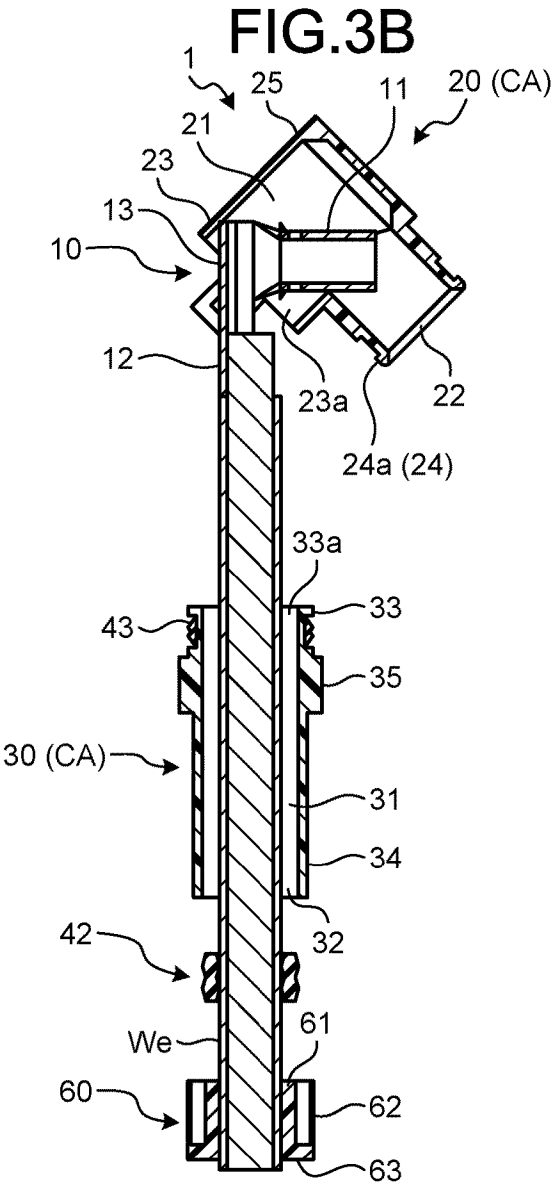
Figure 3A:
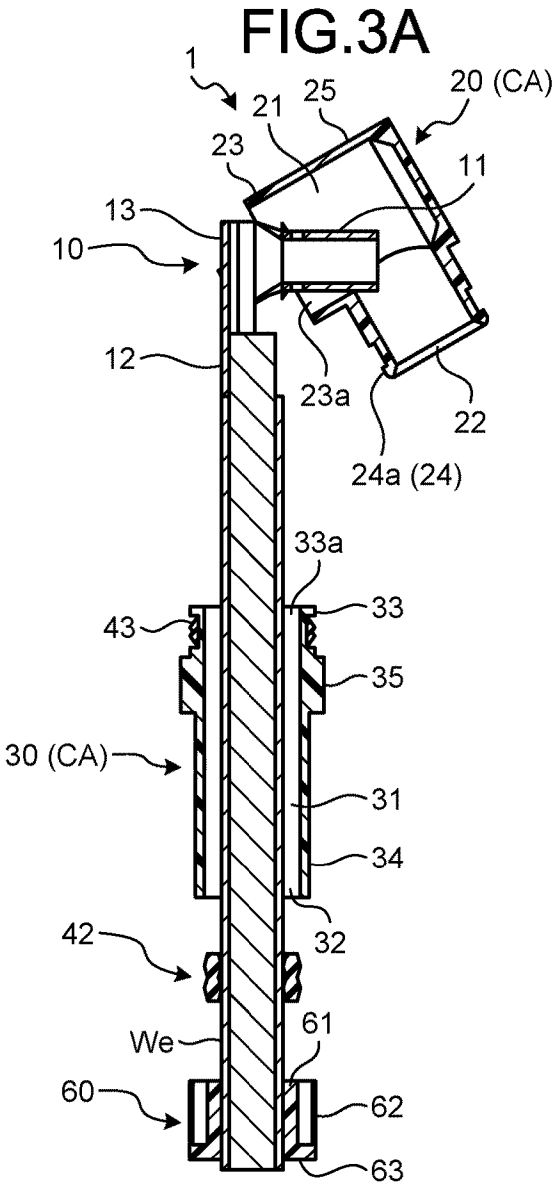
Figure 4B:
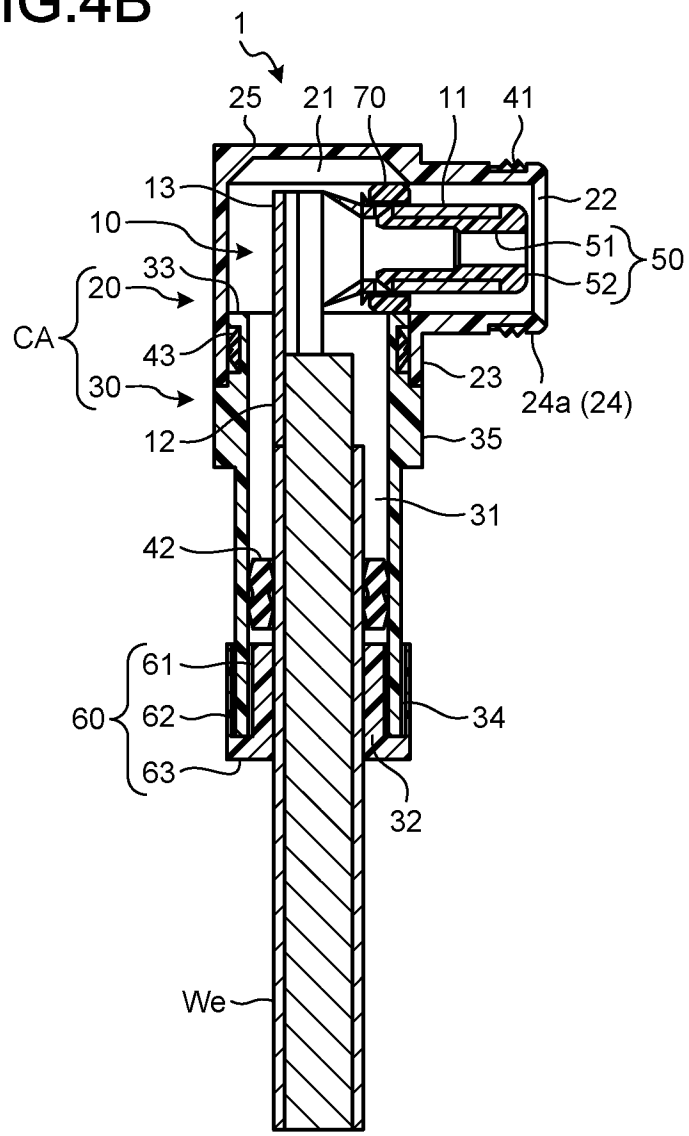
FIGS. 4A and 4B are a diagrams for explaining the assembly process of the connector of the embodiment.
Figure 4A:
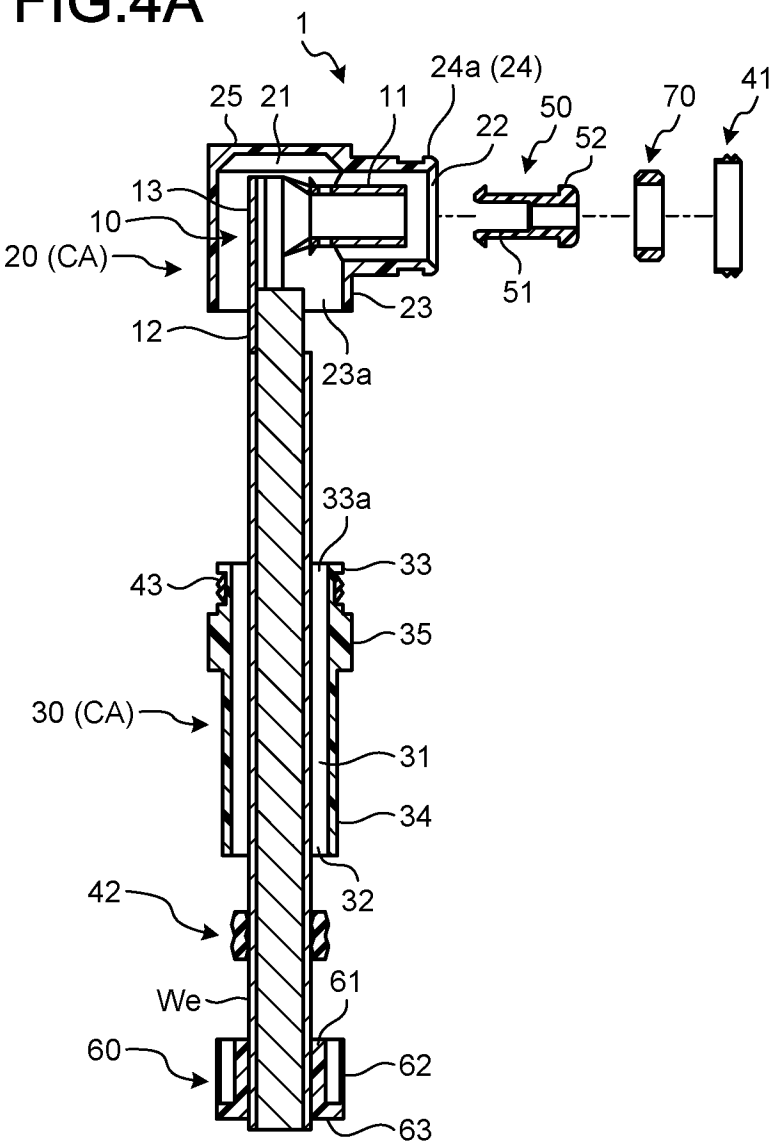

For example, in the connector 1 according to the present embodiment, the electric wire We before being connected to the terminal metal fitting 10 or the electric wire We after being connected to the terminal metal fitting 10 is inserted into the second housing chamber 31 of the second housing member 30, the space portion formed inside the water sealing member 42, and the space portion formed inside the electric wire holding tool 60. In the connector 1, the tip end of the terminal connection part 11 is inserted into the first housing chamber 21 of the first housing member 20 from the opening 23*a* of the opening part 23 (FIG. 3A). For example, in this example, the tip end of the terminal connection part 11 is inserted from the opening 23*a*, while the cylinder axis directions of the terminal connection part 11 and the opening part 23 are intersected with each other (in other words, while the terminal connection part 11 is inclined with respect to the opening part 23). Then, in the connector 1, the terminal connection part 11 is housed at a prescribed position in the first housing chamber 21), while relatively rotating the terminal metal fitting 10 in the first housing chamber 21 (FIG. 3B and FIG. 3C). Then, in the connector 1, the opening part 33 of the second housing member 30 is fitted to the opening part 23 of the first housing member 20 in an inserting manner, the water sealing member 42 is fitted to the second housing chamber 31 of the second housing member 30, and the electric wire drawing port 32 of the second housing member 30 is closed by the electric wire holding tool 60 (FIG. 4A and FIG. 4B). Moreover, in the connector 1, the terminal holding tool 70 is fitted to the first housing chamber 21 of the first housing member 20, and the finger touch prevention tool 50 is fitted to the terminal connection part 11 in an inserting manner (FIG. 4A and FIG. 4B). The water sealing member 41 may also be assembled to the outer peripheral wall of the end portion 24*a* of the first cylinder body 24 during the assembly process of the terminal holding tool 70 and the like, or may also be assembled to the outer peripheral wall in advance.

As described above, in the connector 1 according to the present embodiment, the housing tool CA has a structure divided into the first housing member 20 and the second housing member 30. In the connector 1, the first housing member 20 is formed in a bent shape including the first housing chamber 21 formed therein that houses the terminal connection part 11, the terminal insertion port 22 through which the counterpart terminal is inserted into the first housing chamber 21, and the opening 23*a* through which the intersecting terminal metal fitting 10 at the electric wire connection part 12 side is drawn out to the outside. The second housing member 30 includes the second housing chamber 31 formed therein that houses the electric wire connection part 12 of the terminal metal fitting 10 drawn out from the opening 23*a* of the first housing member 20 with the end of the electric wire We. The second housing member 30 also includes the electric wire drawing port 32 through which the electric wire We is drawn out to the outside, and the opening 33*a* through which the terminal metal fitting 10 at the terminal connection part 11 side is drawn out to the outside. Consequently, with the connector 1, it is possible to reduce the physical size in the terminal insertion and extraction direction, without waiting for the resin agent to cure or waiting for the potting agent to cure as in the conventional example. In particular, the connector 1 in this example is formed in an L-shaped connector in which the terminal metal fitting 10 and the first housing member 20 form an L-shape. Consequently, it is possible to more significantly reduce the physical size in the terminal insertion and extraction direction.

Moreover, the connector 1 according to the present embodiment has a configuration in which the terminal metal fitting 10 is first housed in the first housing chamber 21 of the first housing member 20, while relatively rotating the terminal metal fitting 10 after the terminal connection part 11 is inserted from the tip end, and then the second housing member 30 is assembled to the first housing member 20. In other words, in the connector 1, by forming the housing tool CA in a structure divided into the first housing member 20 and the second housing member 30, it is possible to form the opening part 23 and the first housing chamber 21 of the first housing member 20 into shapes enabling the terminal connection part 11 that has passed through the opening 23*a* of the opening part 23 to be inserted into the first housing chamber 21 from the tip end, and enabling the terminal connection part 11 to be housed at a prescribed position in the first housing chamber 21, while relatively rotating the terminal metal fitting 10 inside the first housing chamber 21 after the terminal connection part 11 is inserted. Consequently, from this point also, the connector 1 can reduce the physical size in the terminal insertion and extraction direction, without waiting for the resin agent to cure, or waiting for the potting agent to cure as in the conventional example.

In this manner, the connector 1 according to the present embodiment can reduce the physical size in the terminal insertion and extraction direction while suppressing reduction in productivity.

Moreover, by using the housing tool CA having the divided structure as described above, the connector 1 has following advantages.

Figure 5:
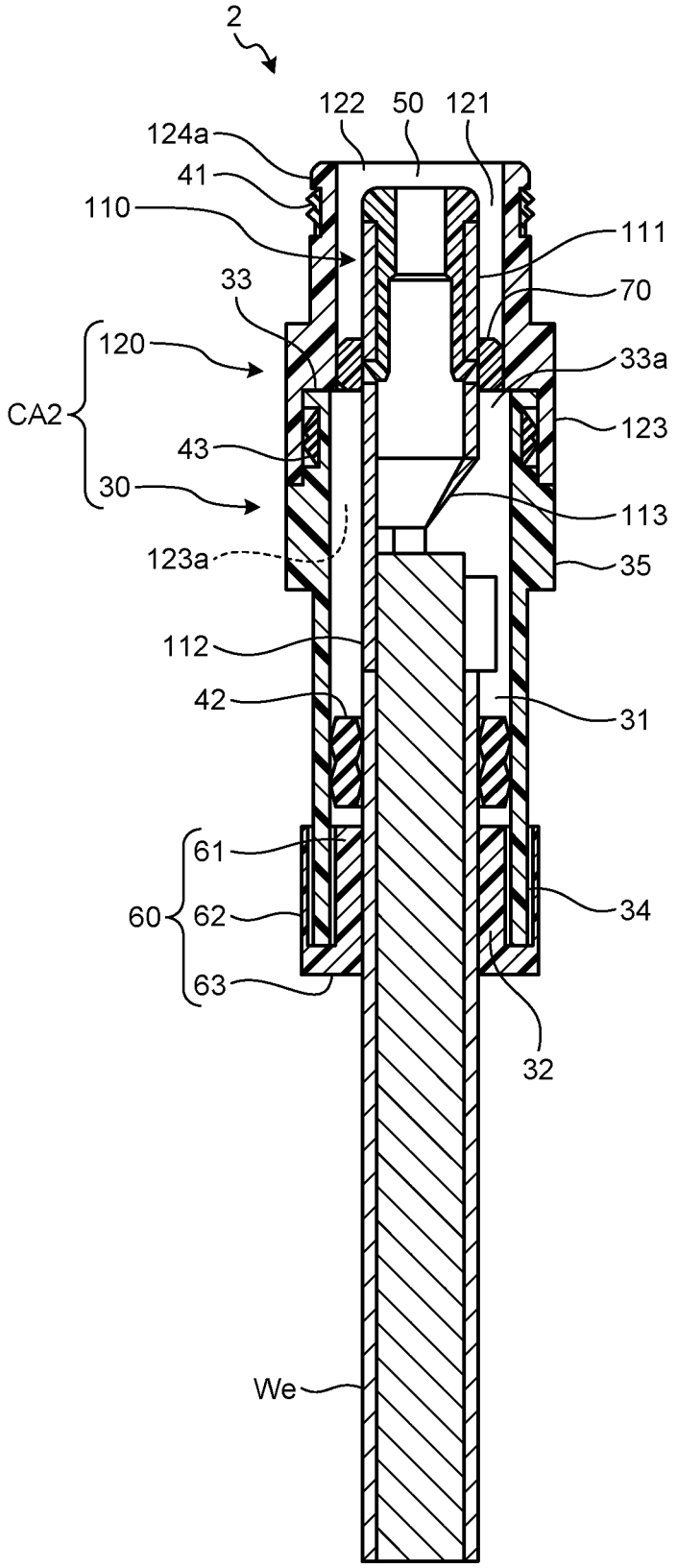
FIG. 5 is a sectional view illustrating an application example of the connector of the embodiment to another form, after the assembly has completed.

In the example described above, the L-shaped connector is used as an example of the connector 1. However, with the housing tool CA of the connector 1, the second housing member 30 can also be used in another connector 2 (FIG. 5). In other words, the second housing member 30 in the connector 1 according to the present embodiment can be shared with another connector 2.

The connector 2 is a connector configured as what is called an I-shaped connector. The connector 2 includes a terminal metal fitting 110 and a housing tool CA2 (FIG. 5).

The terminal metal fitting 110 is formed in a female shape from a conductive material such as metal (copper, copper alloy, aluminum, aluminum alloy, and the like). Similar to the terminal metal fitting 10 of the connector 1, the terminal metal fitting 110 includes a terminal connection part 111, an electric wire connection part 112, and a coupling part 113 (FIG. 5). However, the terminal metal fitting 110 is formed as a linear terminal (=I-shaped terminal) in which the terminal insertion and extraction direction at the terminal connection part 111 and the electric wire drawing direction at the electric wire connection part 112 are disposed on the same axial line. In this example also, the terminal connection part 111 is formed in a cylindrical shape.

Similar to the housing tool CA of the connector 1, the housing tool CA2 houses therein the terminal metal fitting 110 with the end of the electric wire We, fits the terminal connection part of the counterpart terminal to the terminal connection part 111 of the terminal metal fitting 110 in an inserting manner, and draws out the electric wire We from the inside to the outside. The housing tool CA2 is formed of an insulation material such as synthetic resin. The housing tool CA2 includes a first housing member 120 and the second housing member 30 which is the same as that in the housing tool CA of the connector 1. The first housing member 120 and the second housing member 30 are integrated by being fitted to each other (FIG. 5).

The first housing member 120 includes a first housing chamber 121 formed therein that houses the terminal connection part 111 and a terminal insertion port 122 through which the counterpart terminal is inserted into the first housing chamber 121 (FIG. 5). Moreover, the first housing member 120 includes an opening 123*a* through which the terminal metal fitting 110 at the electric wire connection part 112 side is drawn out to the outside (FIG. 5). The first housing member 120 includes a cylinder opening part 123 provided with the opening 123*a* (FIG. 5).

In the first housing member 120, the first housing chamber 121 is formed so as to match the shape of the terminal metal fitting 110, and the terminal insertion port 122 and the opening 123*a* are disposed so as to match the shape of the terminal metal fitting 110 (FIG. 5). The first housing member 120 is formed in a cylinder shape in which the orthogonal direction with respect to the terminal insertion port 122 and the orthogonal direction with respect to the opening 123*a* of the opening part 123 of the first housing member 120 are disposed on the same cylinder axis. The first housing member 120 in this example is formed from a single cylinder body both ends of which in the cylinder axis direction are opened. The first housing member 120 is formed in a linear shape so as to house the terminal metal fitting 110 serving as an I-shaped terminal. In this example, the linear shape first housing member 120 formed in a cylindrical shape is used as an example. In the first housing member 120, an opening at one end is used as the terminal insertion port 122, and an opening at the other end is used as the opening 123*a* of the opening part 123. In the first housing member 120, the other end is used as the opening part 123.

In the first housing member 120 in this example, the terminal connection part 111 is housed in the first housing chamber 121 on the same cylinder axis, and the electric wire connection part 112 and the coupling part 113 are drawn out to the outside from the opening 123*a* with the end of the electric wire We.

In the connector 2, the housing tool CA2 is formed by integrating the first housing member 120 and the second housing member 30 by fitting the opening parts 123 and 33 to each other in an inserting manner. In this example, the opening part 33 of the second housing member 30 is fitted to the inside of the opening part 123 of the first housing member 120 in an inserting manner.

For example, in the connector 2, the electric wire We before being connected to the terminal metal fitting 110 or the electric wire We after being connected to the terminal metal fitting 110 is inserted into the second housing chamber 31 of the second housing member 30, the space portion formed inside the water sealing member 42, and the space portion formed inside the electric wire holding tool 60. In the connector 2, the terminal connection part 111 is housed in the first housing chamber 121 of the first housing member 120, by inserting the tip end of the terminal connection part 111 from the opening 123*a* of the opening part 123. Then, in the connector 2, the opening part 33 of the second housing member 30 is fitted to the opening part 123 of the first housing member 120 in an inserting manner, the water sealing member 42 is fitted to the second housing chamber 31 of the second housing member 30, and the electric wire drawing port 32 of the second housing member 30 is closed by the electric wire holding tool 60. Moreover, in the connector 2, the terminal holding tool 70 is fitted to the first housing chamber 121 of the first housing member 120, and the finger touch prevention tool 50 is fitted to the terminal connection part 111 in an inserting manner. The water sealing member 41 may also be assembled to the outer peripheral wall of an end portion 124*a* of the first housing member 120 at the terminal insertion port 122 side during the assembly process of the terminal holding tool 70 and the like, or may be assembled to the outer peripheral wall in advance.

The second housing member 30 may be shared between the connectors 1 and 2. In other words, when the diameters of the electric wires of the terminal metal fittings 10 and 110 are the same, the electric wire connection parts 12 and 112 may be formed into a common shape, regardless of whether the terminal connection parts 11 and 111 are female or male, or regardless of the difference in disposing the terminal connection parts 11 and 111 with respect to the electric wire connection parts 12 and 112. Consequently, in this example, the second housing member 30 in which the electric wire connection parts 12 and 112 are housed may be shared between the connectors 1 and 2 provided with different terminal metal fittings 10 and 110. In this manner, the connector 1 according to the present embodiment can share the second housing member 30 with the connector 2. Consequently, it is possible to reduce cost, for example.

In the connector according to the present embodiment, the housing tool has a structure divided into the first housing member and the second housing member. In the connector, the first housing member is formed in a bent shape including the first housing chamber formed therein that houses the terminal connection part, the terminal insertion port through which the counterpart terminal is inserted into the first housing chamber, and the opening through which the intersecting terminal metal fitting at the electric wire connection part side is drawn out to the outside. The second housing member includes the second housing chamber formed therein that houses the electric wire connection part of the terminal metal fitting drawn out from the opening of the first housing member with the terminal of the electric wire, the electric wire drawing port through which the electric wire is drawn out to the outside, and the opening through which the terminal metal fitting at the terminal connection part side is drawn out to the outside. Consequently, the connector can reduce the physical size in the terminal insertion and extraction direction without waiting for the resin agent to cure or waiting for the potting agent to cure as in the conventional example. In other words, the connector according to the present invention is capable of reducing the physical size in the terminal insertion and extraction direction while suppressing reduction in productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A water-resistant connector, comprising:

a terminal metal fitting that includes a terminal connection part electrically connected to a counterpart terminal of a counterpart connector, and an electric wire connection part electrically connected to an end of an electric wire;

a housing tool that houses the terminal metal fitting with the end of the electric wire; and an electric wire holding tool that holds the electric wire, wherein the terminal metal fitting is an intersecting terminal in which a terminal insertion and extraction direction at the terminal connection part is intersected with an electric wire drawing direction at the electric wire connection part, the housing tool includes a first housing member and a second housing member that are integrated by fitting cylinder opening parts to each other in an inserting manner, the first housing member includes a first housing chamber formed therein that houses the terminal connection part, a terminal insertion port through which the counterpart terminal is inserted into the first housing chamber, and an opening of the opening part of the first housing member through which the terminal metal fitting at the electric wire connection part side is drawn out to outside, and the first housing member is formed in a bent shape in which an orthogonal direction with respect to the terminal insertion port is intersected with an orthogonal direction with respect to the opening of the opening part of the first housing member so as to match an intersection angle of the terminal insertion and extraction direction and the electric wire drawing direction at the terminal metal fitting, the second housing member includes a second housing chamber formed therein that houses the electric wire connection part of the terminal metal fitting drawn out from the opening of the first housing member with the end of the electric wire, an electric wire drawing port through which the electric wire is drawn out to outside and to which the electric wire holding tool is fitted in an inserting manner, and an opening of the opening part of the second housing member through which the terminal metal fitting at the terminal connection part side is drawn out to outside, and in the electric wire drawing direction, the second housing member is placed on the electric wire side than the terminal connection part.

2. The water-resistant connector according to claim 1, wherein the first housing member forms the opening part of the first housing member and the first housing chamber of the first housing member into shapes enabling the terminal connection part that has passed through the opening of the opening part of the first housing member to be inserted into the first housing chamber from a tip end, and enabling the terminal connection part to be housed at a prescribed position in the first housing chamber, while relatively rotating the terminal metal fitting inside the first housing chamber after the terminal connection part is inserted.

3. The water-resistant connector according to claim 2, wherein the first housing member has a reduced volume of the first housing chamber within a range capable of securing an insertion trajectory of the tip end of the terminal connection part and a relative rotation trajectory of the terminal metal fitting in the first housing chamber.

4. The water-resistant connector according to claim 1, wherein the terminal metal fitting is formed in an L-shaped terminal in which the terminal insertion and extraction direction is orthogonal to the electric wire drawing direction, and the first housing member is formed in an L-shape in which an orthogonal direction with respect to the terminal insertion port is orthogonal to an orthogonal direction with respect to the opening of the opening part of the first housing member.

5. The water-resistant connector according to claim 2, wherein the terminal metal fitting is formed in an L-shaped terminal in which the terminal insertion and extraction direction is orthogonal to the electric wire drawing direction, and the first housing member is formed in an L-shape in which an orthogonal direction with respect to the terminal insertion port is orthogonal to an orthogonal direction with respect to the opening of the opening part of the first housing member.

6. The water-resistant connector according to claim 3, wherein the terminal metal fitting is formed in an L-shaped terminal in which the terminal insertion and extraction direction is orthogonal to the electric wire drawing direction, and the first housing member is formed in an L-shape in which an orthogonal direction with respect to the terminal insertion port is orthogonal to an orthogonal direction with respect to the opening of the opening part of the first housing member.

7. The water-resistant connector according to claim 1, further comprising:

a water sealing member that is housed in the second housing chamber, and that is brought into close contact with an inner wall surface of the second housing member and an outer peripheral wall of the electric wire on a same axis of the electric wire.

8. The water-resistant connector according to claim 2, further comprising:

a water sealing member that is housed in the second housing chamber, and that is brought into close contact with an inner wall surface of the second housing member and an outer peripheral wall of the electric wire on a same axis of the electric wire.

9. The water-resistant connector according to claim 3, further comprising:

a water sealing member that is housed in the second housing chamber, and that is brought into close contact with an inner wall surface of the second housing member and an outer peripheral wall of the electric wire on a same axis of the electric wire.

10. The water-resistant connector according to claim 4, further comprising:

a water sealing member that is housed in the second housing chamber, and that is brought into close contact with an inner wall surface of the second housing member and an outer peripheral wall of the electric wire on a same axis of the electric wire.

11. The water-resistant connector according to claim 5, further comprising:

a water sealing member that is housed in the second housing chamber, and that is brought into close contact with an inner wall surface of the second housing member and an outer peripheral wall of the electric wire on a same axis of the electric wire.

12. The water-resistant connector according to claim 6, further comprising:

a water sealing member that is housed in the second housing chamber, and that is brought into close contact with an inner wall surface of the second housing member and an outer peripheral wall of the electric wire on a same axis of the electric wire.

13. The water-resistant connector according to claim 1, wherein the first housing member and the second housing member are molded from an insulating material.

14. The water-resistant connector according to claim 1, wherein the first housing member and the second housing member are fitted to engage each other in an inserting manner in only the electric wire drawing direction.

* * * * *